United States Patent [19]

Wojnicki

[11] Patent Number: 4,548,018

[45] Date of Patent: Oct. 22, 1985

[54] APPARATUS FOR HORIZONTALLY FORMING, FILLING AND SEALING FILM POUCH MATERIAL

[76] Inventor: John Wojnicki, 10 Millstone Dr., Cranbury, N.J. 08512

[21] Appl. No.: 625,936

[22] Filed: Jun. 29, 1984

[51] Int. Cl.[4] ..... B65B 9/08; B65B 5/02

[52] U.S. Cl. ..... 53/51; 53/137; 53/562

[58] Field of Search ..... 53/51, 137, 562, 550, 53/389, 570, 266 A

[56] References Cited

U.S. PATENT DOCUMENTS

| | | | |
|---|---|---|---|
| Re. 30,010 | 5/1979 | Shanklin . | |
| 1,844,806 | 2/1932 | Smith et al. . | |
| 1,968,211 | 7/1934 | Langhammer et al. . | |
| 2,304,395 | 12/1942 | Bodolay . | |
| 2,304,396 | 12/1942 | Bodolay . | |
| 2,651,578 | 9/1953 | Bodolay et al. . | |
| 2,877,609 | 3/1959 | Bodolay et al. . | |
| 3,006,122 | 10/1961 | Weishaus . | |
| 3,047,991 | 8/1962 | Siegel et al. . | |
| 3,233,527 | 2/1966 | Membrino . | |
| 3,302,369 | 2/1967 | Vinciguerra . | |
| 3,327,451 | 6/1967 | Forman . | |
| 3,339,337 | 9/1967 | Rapp et al. | 53/562 |
| 3,380,222 | 4/1968 | Bergmann et al. . | |
| 3,429,100 | 2/1969 | Zelnick et al. . | |
| 3,462,913 | 8/1969 | Bodolay et al. . | |
| 3,471,000 | 10/1969 | Bodolay et al. . | |
| 3,496,700 | 2/1970 | McCabe et al. . | |
| 3,540,183 | 11/1970 | Bodolay et al. . | |
| 3,564,809 | 2/1971 | Keramas . | |
| 3,581,461 | 6/1971 | McDurmont . | |
| 3,583,888 | 6/1971 | Shanklin . | |
| 3,638,784 | 2/1972 | Bodolay et al. . | |
| 3,688,465 | 9/1972 | Benitez et al. | 53/562 X |
| 3,721,061 | 3/1973 | Bodolay et al. . | |
| 3,727,373 | 4/1973 | MacLeod . | |
| 3,763,628 | 10/1973 | Bodolay et al. . | |
| 3,996,720 | 12/1976 | Hayduchok . | |
| 4,202,153 | 5/1980 | Lerner et al. . | |
| 4,205,504 | 6/1980 | Gregoire . | |
| 4,241,562 | 12/1980 | Meyer . | |
| 4,365,458 | 12/1982 | Palmer et al. . | |

*Primary Examiner*—Horace M. Culver
*Attorney, Agent, or Firm*—Sperry, Zoda & Kane

[57] ABSTRACT

A machine for forming, filling and sealing pouches out of continuously fed film material wherein the material forming the pouches extends in a horizontal direction during all steps of the process. Continuous film is fed from a roll thereof with the roll being power driven to prevent stretching of the material as it passes through the various processing stations. The film material can be stamped for marking thereon and can include a header area which is sealed and may or may not have a card placed therein or thereon. The top of the individual pouches may include an aperture therethrough for display mounting or air evacuation. The film then travels to a side sealing device which extends laterally across the moving film for sealing between adjacent pouches. The pouches are loaded with product at a position where immediately thereafter the ends thereof are sealed. At all times the pouch extends in a horizontal position to prevent the weight of the product from interfering with the filling and sealing operations. A movable carriage is included which transports the film in a forward location simultaneously with the roll of film being powered to facilitate release of film therefrom. In this manner the film is transported through the system to maintain the squareness of the formed bags by virtually eliminating stretching or bunching of the traveling material.

24 Claims, 6 Drawing Figures

APPARATUS FOR HORIZONTALLY FORMING, FILLING AND SEALING FILM POUCH MATERIAL

BACKGROUND OF THE INVENTION

1. Field of the Invention

The present invention deals with the field of packaging devices which take a continuous roll of plastic or other material which may or may not be pre-printed and form this double layer of film into packages and then load whatever product is to be packaged therein and finally seal the end through which the loading is performed. This can be performed in a variety of orientations of the product and/or of the pouch.

2. Description of the Prior Art

A number of devices are utilized for such packaging and have been subject of United States patents such as U.S. Pat. No. 1,844,806 patented Feb. 9, 1932 to E. L. Smith et al., on an Article Feeding Mechanism; U.S. Pat. No. 2,304,395 patented Dec. 8, 1942 to S. Bodolay on a Rear Folder For Wrapping Machines; U.S. Pat. No. 2,304,396 patented Dec. 8, 1942 to S. Bodolay on a Wrapping Machine Folder; U.S. Pat. No. 2,651,578 patented Sept. 8, 1953 to S. Bodolay et al., on a Package And Method Of Making It; U.S. Pat. No. 2,877,609 patented Mar. 17, 1959 to S. Bodolay et al., on a Machine For Making Bags From A Continuous Web; U.S. Pat. No. 3,462,913 patented Aug. 26, 1969 to J. Bodolay et al., on a Combination Multiple Bag Making And Compartment Bag Making Machine; U.S. Pat. No. 3,471,000 patented Oct. 7, 1969 to S. Bodolay et al., on a Pre-Packaging Mechanism; U.S. Pat. No. 3,540,183 patented Nov. 17, 1970 to W. Bodolay et al., on a Machine For Making Two Compartment Unitary Bag; U.S. Pat. No. 3,638,784 patented Feb. 1, 1972 to W. Bodolay et al., on a Two Compartment Unitary Bag; U.S. Pat. No. 3,721,061 patented Mar. 20, 1973 to W. Bodolay on an Automatic Bag Neck Gatherer And Tying Mechanism; U.S. Pat. No. 3,763,628 patented Oct. 9, 1973 to W. Bodolay on a Bag Loader; U.S. Pat. No. 1,968,211 patented July 31, 1934 to P. Langhammer et al., on a Bottle Hooding Device; U.S. Pat. No. 3,006,122 patented Oct. 31, 1961 to A. Weishaus on a Heat Sealing Apparatus And Method; U.S. Pat. No. 3,047,991 patented Aug. 7, 1962 to M. Siegel et al., on an Impulse Sealing Apparatus; U.S. Pat. No. 3,233,527 patented Feb. 8, 1966 to H. Membrino on a Bag Making Machine; U.S. Pat. No. 3,302,369 patented Feb. 7, 1967 to A. Vinciguerra on Automatic Packaging Machines; U.S. Pat. No. 3,327,451 patented June 27, 1967 to H. M. Forman on a Wrapping Machine; U.S. Pat. No. 3,380,222 patented Apr. 30, 1968 to K. H. Bergmann et al., on a Method And Apparatus For Filling, Sealing, And Packaging Of Bags And Similar Containers; U.S. Pat. No. 3,429,100 patented Feb. 25, 1969 to S. Zelnick et al., on a Method And Apparatus For Sealing Film-Wrapped Packages; U.S. Pat. No. 3,496,700 patented Feb. 24, 1970 to W. E. McCabe et al., on a Packaging Apparatus; U.S. Pat. No. 3,564,809 patented Feb. 23, 1971 to J. G. Keramas on an Automatic Heat Seal Packaging Machine and Method; U.S. Pat. No. 3,581,461 patented June 1, 1971 to W. McDurmont on a Packaging Apparatus; U.S. Pat. No. 3,583,888 patented June 8, 1971 to F. G. Shanklin on a Packaging Apparatus And Method; U.S. Pat. No. 3,727,373 patented Apr. 17, 1973 to N. MacLeod on a Bag Forming Filling And Sealing Apparatus; U.S. Pat. No. 3,996,720 patented Dec. 14, 1976 to L. Hayduchok, on a Yarn Cutting And Packaging Machine; U.S. Pat. No. 4,202,153 patented May 13, 1980 to B. Lernet et al., on a Method And Apparatus For Loading Containers Horizontally; U.S. Pat. No. Re. 30,010 Reissued May 29, 1979 to R. Garrett Shanklin on a Packaging Apparatus And Method; U.S. Pat. No. 4,205,504 patented June 3, 1980 to C. Gregoire et al., on a Method And Device For Making Envelopes From A Continuous Web And Including The Stuffing And Sealing Of Those Envelopes; U.S. Pat. No. 4,241,562 patented Dec. 30, 1980 to A. Meyer on a Method And Apparatus For Automatic Filling Of Bags; and U.S. Pat. No. 4,365,458 patented Dec. 28, 1982 to L. Palmer et al., on a Method And Apparatus For Filling Sleeves With Finished Disc Records And Inserting The Filled Sleeves Into Jackets.

Most prior art devices such as those shown in the above-identified patents orient the formed pouch vertically for loading. That is the uppermost edge of the vertically hanging pouch is still not yet sealed at the time when the product is loaded therein. Then at a further downstream station the upper edge is sealed. A problem occurs with such systems wherein the weight of the product is critical since it may stretch the pouch in an unnatural manner such that when the final seal is made the end product is a non-square sealed pouch. Also the seal may not be complete. These problems are overcome by a device such as the present invention wherein the weight of the product is supported by a table or carriage at the time the final end seal is made thereby eliminating any problems due to the actual weight of the product.

SUMMARY OF THE INVENTION

The present invention provides an apparatus for horizontally forming, filling and sealing film pouch material which includes a frame means which supports a number of processing stations. The frame means can generally be defined to be divided between a first section and a second section. A support table extends throughout the first section for supporting the horizontally extending film pouch material and a movable support carriage is located in the second section for similarly supporting the film pouch material but being longitudinally movable along the frame means. This support carriage is movable between a first position where it is in approximate abutting or adjacent position with respect to the first section and a second position where it is further downstream therefrom.

A film unwinding device is included which continuously supplies film pouch material to the first section of the frame means. A roller means such as a plurality of rollers is also included which guides the film pouch material from the film unwinding device onto the support table into an orientation extending horizontally thereon.

A header sealing means is positioned on the support table such as to be selectively engageable with respect to the horizontally extending film pouch material to form a header seal therein somewhat adjacent to the top area thereof. Also a labeling means or other accessories may be included upon the horizontally extending support table such as a hot stamp marking or a header card to the film pouch material traveling thereon. Furthermore a film registration means which may include a photocell can be positioned upon the support table to read regularly positioned markings on the film pouch material and correct the positioning of the movement of this material along the transporting system.

A side sealing means is preferably secured with respect to the support carriage to be movable therewith. This side sealing means extends laterally across the support carriage to side seal the horizontally extending film material at desired locations to thereby form the individual pouches connected at the open end by an uncut strip of material. This side sealing means is movable between an opened position which is adapted to receive film material therein and close the clamping position forming a side seal between adjacent pouches. The side sealing means is movable to the closed clamped position while the support carriage is in the first position but prior to movement of the support carriage toward the second position. In this manner the film pouch material is urged to move with the carriage as it moves from the first position to the second position. The side sealing means is movable to the opened position only after the support carriage completes movement to the second position but prior to the initiating of movement back toward the first position.

An end sealing means is secured with respect to the support carriage to be movable therewith between an opened position where it is adapted to receive the horizontally extending film material therein and a closed clamping position wherein an end seal is formed on the film pouch. The end sealing means is movable to the closed clamping position while the support carriage is in the first position and prior to movement toward the second position. In this manner the end sealing means similarly as the side sealing means will urge the film pouch material to move with the carriage as the support carriage moves from the first position to the second position. The end sealing means also is movable to the opened position only after the support carriage completes its movement to the second position but prior to initiating movement back toward the first position.

Also an infeed chute means is included which is positioned at the location as the end sealing means and is adapted to fill product into each horizontally extending film pouch when the end sealing means is in the opened position. This infeed chute means being positioned at the exact same location of the end sealing means is adapted to extend between the upper and lower jaws of the end sealing means in such a fashion as to load product and can be withdrawn prior to closing of the upper and lower jaw means for end sealing thereof.

A trim clamping means is included which is movable from an opened position adapted to receive the excess support trim material to a closed clamping position fixedly gripping the excess trim material. This trim clamping means is secured with respect to the frame and is adapted to move to the closed clamping position to grip the excess trim portion while the support carriage is in the second position and prior to release of the film material by the side sealing means and the end sealing means. In this manner movement of the film material will be prevented as the support carriage travels from the second position back to the first position. This trim clamping means is movable to the opened position releasing said trim portion of the film material while the support carriage is in the first position and after the side sealing means and the end sealing means has moved to the closed clamping position. In this manner movement of the film material will be allowed with the support carriage as it moves from the first position to the second position.

Furthermore a product clamping means is included which is secured with respect to the frame means and is movable between an opened position adapted to receive the fully formed, filled and sealed horizontally extending pouch therein and a closed clamping position firmly gripping same. The product clamping means will be adapted to move to the closed clamping position when the trim clamping means is also in the closed clamping position to remove the completed pouch from the excess trim material. The product clamping means may then deposit the product into the product collection means therebelow for counting or collection as necessary. The product clamping means actually is movable in a direction away from the trim portion of the film means wherein this trim portion is gripped in such a manner as to pull the bag away from the trim along the end seal thereof.

A trim waste take-up assembly may also be included adjacent to the product clamping means for gathering of the trim waste after product removal therefrom. Preferably this trim waste take-up assembly is power driven.

The film unwinding device preferably will include a drive means to facilitate the supplying of film pouch material therefrom. This drive means should be rendered operative whenever the support carriage is moving from the first position to the second position. Also preferably the circumferential speed of the film supply roll will be equal to longitudinal speed of the support carriage such that no bunching or stretching will occur as the film material is being transported along the first and second sections of the frame means.

Preferably the infeed chute means will extend between the upper and lower jaws of the end sealing means in such a fashion as to actually enter into the pouch area such that product can be directly placed therein to facilitate product placement.

Movement of the carriage from a first position to the second position should be through a distance equal to the width of a single film pouch. In this manner each individual pouch will be sequentially placed and oriented properly at the side sealing means for side sealing thereof and presented in front of the infeed chute means for product filling thereof.

To facilitate registration of the transporting film pouch material a coded mark which is regularly positioned thereon should be capable of being read by a film registration means such as a photocell. Preferably this means will be an electronic device which can read the regularly positioned coded markings to indicate to the system that the transporting film material is properly located after each cycle of movement of the support carriage.

The labeling means may be one of a variety of different types of devices. One such device would be a hot stamping means for fixing a desired designation onto the exterior of the film pouch material. Alternatively this labeling means could be a header card assembly adapted to place a card into or onto the header area of each individual film pouch to facilitate rack display. Furthermore a punch means may be included for punching a hole in the film for air evacuation or to facilitate rack display. Furthermore a labeling means could actually place a label onto the exterior of the film pouch if so desired.

The apparatus of the present invention is particularly usable for pouches having a reclosable zipper in the upper area thereof. Such pouches may be used with or without a header area but allows for reclosing of the film seal by the customer as desired.

An infeed conveyor may be included to directly provide product to the infeed chute means for movement by any type of a power means such as a piston power means for driving of the product into the individual pouches and for withdrawing the empty infeed chute therefrom.

It is an object of the present invention to provide an apparatus for horizontally forming, filling and sealing film pouch material which maintains film pouch material in a horizontally extending orientation to facilitate loading thereof.

It is an object of the present invention to provide an apparatus for horizontally forming, filling and sealing film pouch material which includes a film unwinding device which is power driven to prevent bunching or stretching of the film pouch material to maintain proper sealing and squareness of the pouches formed thereby.

It is an object of the present invention to provide an apparatus for horizontally forming, filling and sealing film pouch material which includes a roller means for guiding of film pouch material from the film unwinding device to the horizontally extending support table.

It is an object of the present invention to provide an apparatus for horizontally forming, filling and sealing film pouch material which includes a header sealing means to form a header seal adjacent to the top area thereof.

It is an object of the present invention to provide an apparatus for horizontally forming, filling and sealing film pouch material which includes a labeling means to add chosen designations to the film pouch material.

It is an object of the present invention to provide an apparatus for horizontally forming, filling and sealing film pouch material which includes a film registration means to indicate correct or incorrect positioning of transportation of the film pouch material from one processing station to the next.

It is an object of the present invention to provide an apparatus for horizontally forming, filling and sealing film pouch material which includes a side sealing means which is movable with a support carriage to facilitate transporting of the film pouch material through the transport system and which forms a square side seal thereon.

It is an object of the present invention to provide an apparatus for horizontally forming, filling and sealing film pouch material which includes an end sealing means located at the same location as an infeed chute means to increase speed of pouch formation and to minimize floor space required for the processing system.

It is an object of the present invention to provide an apparatus for horizontally forming, filling and sealing film pouch material which includes an infeed chute means which is adapted to extend actually into the pouch to facilitate placement of product therein.

It is an object of the present invention to provide an apparatus for horizontally forming, filling and sealing film pouch material which includes a trim clamping means for facilitating return of the support carriage to a first position while maintaining the film pouch material without movement thereof.

It is an object of the present invention to provide an apparatus for horizontally forming, filling and sealing film pouch material which includes a product clamping means for removal of the finally formed pouches from the excess trim.

It is an object of the present invention to provide an apparatus for horizontally forming, filling and sealing film pouch material which fills pouches horizontally to eliminate problems in such processing systems caused by the weight of the product after placement into the pouch.

It is an object of the present invention to provide an apparatus for horizontally forming, filling and sealing film pouch material which includes a trim waste take-up assembly to facilitate disposal of trim waste.

It is an object of the present invention to provide an apparatus for horizontally forming, filling and sealing film pouch material which includes a drive means to facilitate supplying of film pouch material to the processing system.

It is an object of the present invention to provide an apparatus for horizontally forming, filling and sealing film pouch material which includes a power driven film supply means wherein the circumferential speed of the driven roll is equal to the longitudinal speed of the support carriage drawing film through the system such that bunching or stretching of the film material will be prevented and properly formed and sealed bags will be produced with square corners.

It is an object of the present invention to provide an apparatus for horizontally forming, filling and sealing film pouch material wherein the film pouch material being supplied includes a regularly positioned coded markings thereon for assuring correct film registration.

It is an object of the present invention to provide an apparatus for horizontally forming, filling and sealing film pouch material wherein the infeed chute means includes a power driven piston supplying means. .

It is an object of the present invention to provide an apparatus for horizontally forming, filling and sealing film pouch material wherein the end sealing means includes an upper and lower jaw means which are movable between an open position and a closed position which when in the opened position allows movement of the infeed chute means therebetween into the product pouch for placement therein followed by removal therefrom and sealing by closing of the upper and lower jaw means on the end area.

It is an object of the present invention to provide an apparatus for horizontally forming, filling and sealing film pouch material which includes a product collection means positioned below the product clamping means to receive and collect completed pouches.

It is an object of the present invention to provide an apparatus for horizontally forming, filling and sealing film pouch material which achieves end sealing and product loading at the same processing station.

It is an object of the present invention to provide an apparatus for horizontally forming, filling and sealing film pouch material which includes a cosmetic area which may include hot stamping, header card placement, punching or header seal placement or other similar cosmetic make-ups.

BRIEF DESCRIPTION OF THE DRAWINGS

While the invention is particularly pointed out and distinctly claimed in the concluding portions herein, a preferred embodiment if set forth in the following detailed description which may be best understood when read in connection with the accompanying drawings, in which:

DETAILED DESCRIPTION OF THE PREFERRED EMBODIMENT

Figure 1:
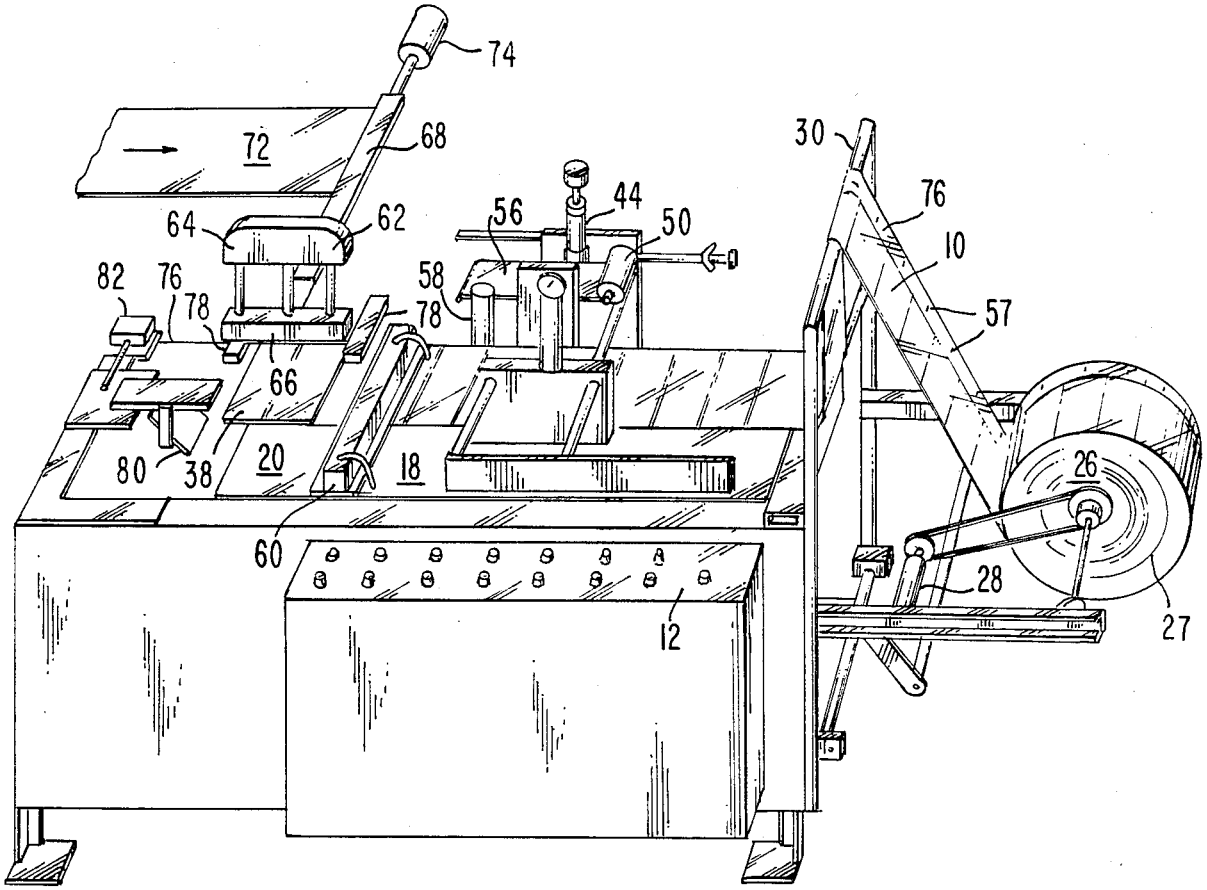
FIG. 1 is a perspective illustration of an embodiment of an apparatus of a horizontally forming, filling and sealing film pouch material of the present invention.
Figure 2:
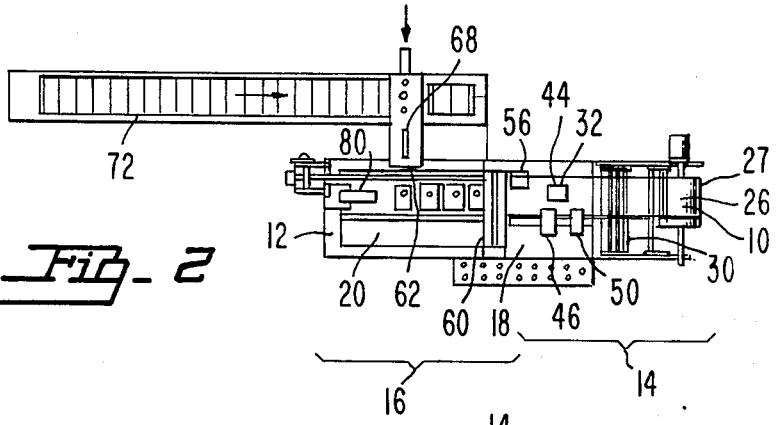
FIG. 2 is a top plan view of another embodiment of the apparatus shown in FIG. 1.
Figure 3:
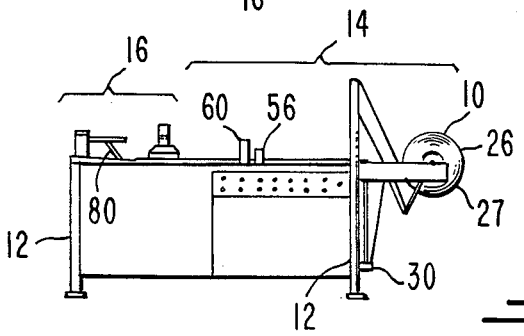
FIG. 3 is a side plan view of another embodiment of the apparatus shown in FIG. 1.
Figure 4:
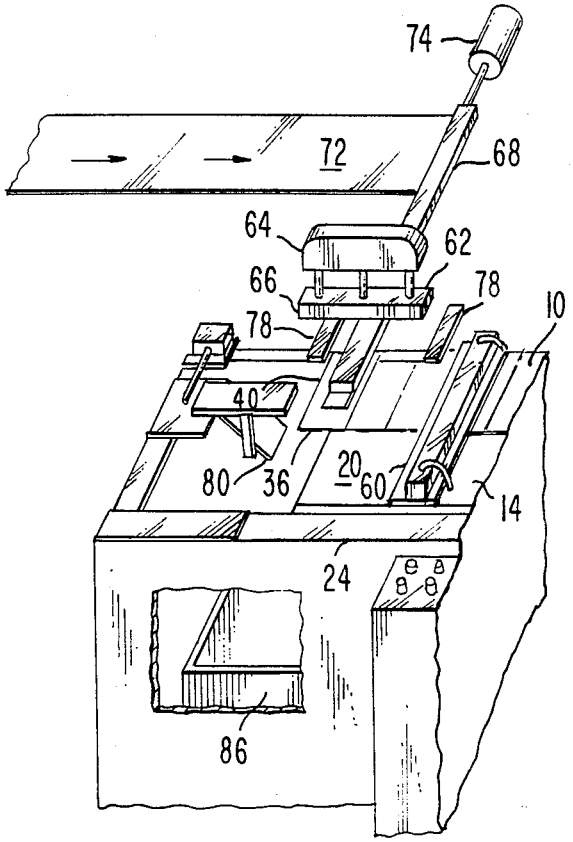
FIG. 4 is a perspective view of an embodiment of the second section of the present invention showing the support carriage in the first position.
Figure 5:
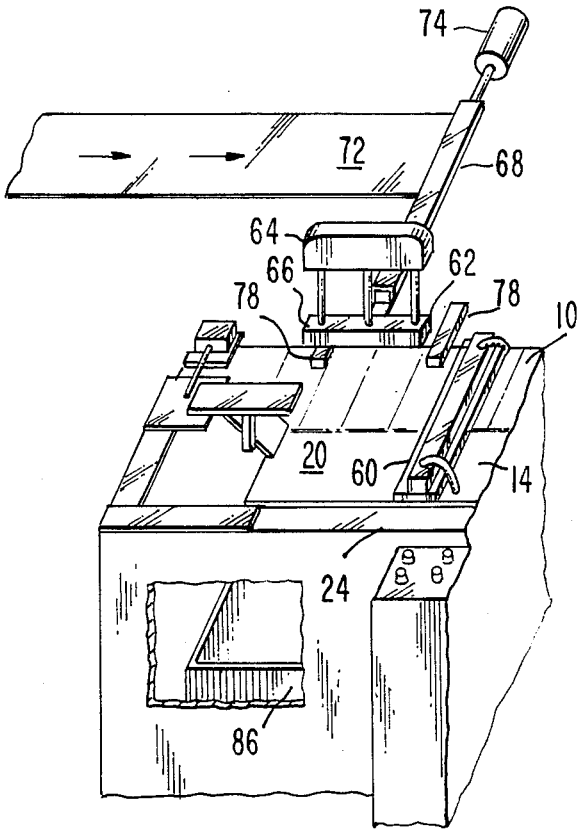
FIG. 5 is an embodiment of the configuration shown in FIG. 4 with the support carriage shown in the second position.
Figure 6:
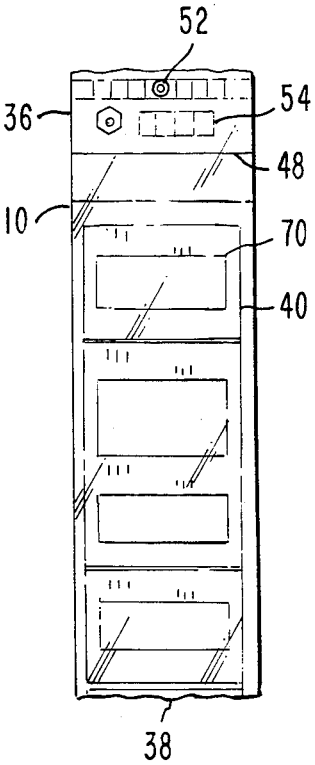
FIG. 6 is a top plan view of an embodiment of a filled film material pouch.

The present invention provides an apparatus for horizontally forming, filling and sealing film pouch material 10 which includes a frame means 12 divided into a first section 14 and a second section 16. The first section 14 includes a support table 18 for maintaining the film pouch material 10 in a horizontally extending orientation laying thereon. Second section 16 includes a support carriage 20 which is movable between a first position 22 adjacent to the support table 18 and a second position 24 spatially disposed therefrom downstream in the processing line.

The film pouch material 10 is supplied to the support table 18 by a film unwinding device 26 which will include a roll 27 of the material which is powered by a drive means 28. Supply from the film unwinding device 26 to the first section 14 is facilitated if the material is caused to pass through a roller means 30 which may take the form of a number of rollers to maintain the squareness and straight flow of the material as it enters the forming, filling and sealing apparatus.

After the material is delivered to the support table 18 the first steps toward forming the bag are initiated. In particular a header sealing means 32 may be included thereon such that a header seal 34 is placed in the top area 36 of the bag to be formed. The end or bottom area 38 is positioned at the opposite end thereof connected by two side areas 40 extending laterally across the path of movement of the film pouch material 10 while on the support table 18.

A labeling means 42 is also positioned adjacent to the path of movement of the film pouch material 10 through the first section 14. This labeling means may take a variety of forms. The labeling means 42 may be a hot stamping means 44 for the application of an actual stamp upon the pouch material by the application of heat thereto in a desired pattern. Alternatively the labeling means 42 may take the form of a header card assembly 46 which is basically a device for laying a card into the header area or onto the header area of a pouch adjacent to the top area 36 thereof in such a fashion that if the header seal 34 is formed this card will be fixed in place. It can also be folded and stapled to the outside of the pouch. It is also possible that the card could be placed within the actual product material rather than the header area. However this header card 48 will convey certain information as desired by the distributor of the product being loaded.

Another possible processing station which may be located in the first section 14 of the apparatus would be a punch means 50 which may apply a punch hole 52 into the bag or header area thereof for air evacuation or to provide a display mounting hole for the finally formed product pouch. Alternatively the labeling means 42 could actually apply a label 54 to the exterior of the bag which may be a gummed label or other type of label adherring in any of a number of ways.

A film registration means will also be positioned upon the support table to indicate positioning of movement of the film pouch material through the processing system. This film registration means 56 will be preferably in the form of a photocell means 58 which is adapted to read regularly positioned coded markings 57 on the film. As shown in FIG. 1 these coded markings will basically be adjacent to the proposed position for each bag such that the position of movement of the film pouch material through the processing system will be known at all times.

A side sealing means 60 will extend laterally across the path of movement of the film pouch material 10. This side sealing means will be selectively movable between an opened position adapted to receive moving film pouch material therein and a closed clamping position wherein heat or other means of forming a side seal between adjacent bags can be applied. Side sealing means 60 is secured with respect to the support carriage to be movable therewith. The side sealing means is movable into the closed position while the support carriage 20 is in the first position. Side sealing means 60 is movable to the opened position only after the support carriage 20 has completed movement to the second position.

An end sealing means 62 is secured with respect to the support carriage to be movable therewith. The end sealing means 52 is adapted to move downwardly to clamp the end area of the film pouch for sealing same after the product has been placed into the pouch. End sealing means 62 preferably takes the form of a lower jaw means 66 and an upper jaw means 64 which are movable with respect to one another to cause the clamping and end sealing of the end area of a bag. When this operation is performed some portion of the film material will be outside of the end seal and this material will be the excess trim 76. The end sealing means is movable to the opened position when the support carriage is in the second position and is movable to the closed position when the support carriage is in the first position.

Infeed chute means 68 is positioned adjacent to the end sealing means 62 and in this embodiment is adapted to pass between the upper jaw means 64 and the lower jaw means 66 while they are in the opened position to deliver product 70 into the film pouch 10. This product is carried by an infeed conveyor 72 to the infeed chute means for delivery. Delivery is facilitated by a piston power means 74 which is operable to stroke inwardly and outwardly to deliver product directly into the film pouch and to remove the delivery means that is the infeed chute means 68 therefrom. Preferably the infeed chute means 68 will actually move between the upper and lower jaw means 64 and 66 to a position where it will extend into the bag to facilitate direct delivery of product 70 therein. The location of the infeed chute means 68 and the end sealing means 62 at the same location along the processing station decreases the length of line required for the apparatus of the present invention and also increases the speed of operation. This is an important time and cost saving aspect of the present apparatus where both end sealing and product placement occur at the same processing station.

After the end seal has been placed the support carriage will move from the first position to the second position carrying the film pouch material 10 therewith. Once the support carriage 20 has reached the second position the trim clamping means 78 will grip the trim 76 and the product clamping means 80 will move to a closed position gripping the finally formed and loaded film pouch. Product clamping means 80 will then move away from the trim clamping means 78 causing release of the product from the trim. The product clamping means 80 can then be opened to release the product to be gathered within the product collection means 86 of any suitable form desired. The trim will then be gathered by the trim waste take-up assembly 82 which may be powered by a trim take-up drive means 84. In this manner the trim can be gathered for recycling or for disposal.

In operation the present invention includes a film unwinding station which is operable upon a roll of film pouch material 10 to supply a continuous web of material through roller means 30 to the labeling area 42. The desired cosmetical information on labeling can then be performed and a header can be formed if necessary and film registration insures proper orientation. The pouch material will then pass to the side sealing means 60 which is secured with respect to the support carriage 20. When the support carriage is in the first position, initially the trim clamping means 28 will be down in a position gripping the film pouch material and the side sealing means 60 and the end sealing means 62 will each be in an opened position. The infeed chute means 68 will then be pushed by the piston power means 74 into the pouch to unload the product therein. Immediately thereafter the piston power means 74 will withdraw the infeed chute means 68 from the pouch. Once this has been performed then the end sealing means 62 will move downwardly into a clamping position. Also the side sealing means 60 can at approximately the same time move downwardly into a product gripping position. In the downward position the side sealing means 60 and the end sealing means 62 will not only form the side and end seals but will also grip the material. Once the material is gripped then the trim clamping means 78 can be released or moved to the opened position.

Then the support carriage initiates movement from the first position 22 to the second position 24. This movement as shown in FIG. 1 is a movement to the left. Once the support carriage 20 has reached a second position the trim clamping means 78 will move downwardly into a gripping position whereas the side sealing means 60 and the end sealing means 62 will move to an opened position. Then the support carriage 20 will initiate movement to the right as shown in FIG. 1 which is a movement from the second position 24 to the first position 22. However when this movement from the second position to the first position is being performed the film pouch material 10 will not be moving but will be maintained in a fixed position with respect to the frame means 12 by the trim clamping means 78 which are gripping the film pouch material 10. This is in view of the fact that the trim clamping means 78 is fixedly secured with respect to frame means 12. However when the support carriage 20 is moving from the first position 22 to the second position 24 the film pouch material 10 will be carried therewith since side sealing means 60 and end sealing means 62 are in a material clamping position and the trim clamping means 78 is in an opened position. This is the manner in which the film pouch material 10 is transported through the system.

The distance of movement between the first position 22 and the second position 24 should be approximately equal to the lateral width of a bag as shown in FIG. 1. In this manner a new bag will be placed in front of the infeed chute means 68 after each cycle or stroke of movement of the support carriage 20. Also the next step of end sealing by end sealing means 62 is performed at the same location as the infeed chute means 68. Also a new pouch will be presented adjacent to the product clamping means 80 for removal from the clamped trim 76.

It is very important that the film pouch material 10 be maintained in a flat and longitudinally straight oriented position upon support carriage 20 and support table 18. There also should be no excess slack or on the other hand stretching of the material while it is being transported through the processing system. This can be best achieved by an inter-relationship between movement of the support carriage between the first and second positions 22 and 24 and the drive means 28 of the power film unwinding device 26. Preferably the drive means 28 of the film unwinding device 26 senses movement of the film pouch material 10 and in particular senses movement of the support carriage from the first position toward the second position. When this movement is sensed it will indicate movement of the film material 10 as a result will initiate operation of drive means 28 to supply film. Preferably the film 10 will be supplied from the drive means 28 in such a manner that the speed of the film being supplied to the roller means 30 is equal to the speed of movement of the support carriage from the first position 22 to the second position 24. This can be achieved if the speed of movement of the support carriage from the first to the second position is equal to the circumferential discharge speed of the film from the film supply roller. In this manner there is no excess slack or bunching as well as no stretching with respect to the film pouch material. This will assure the formation of pouches with square corners and will achieve good seals to all chosen areas.

It also important that the film should always be in a clamped position. It is for this reason that the side sealing means 60 and the end sealing means 62 remain in the clamped position when the support carriage 20 is in the second position 24 until the trim clamping means 78 has moved down into a clamping position. Once the trim clamping means 78 is holding the material then the side sealing means 60 and the end sealing means 62 can be released. Similarly when the support carriage 20 is in the first position the trim clamping means 78 cannot be released until the side sealing means 60 and the end sealing means 62 move downwardly into a closed clamping position. Thereafter the trim clamping means 78 can be released. In this manner the material 10 upon the support carriage 20 will always be clamped to maintain a proper horizontally extending orientation of the film pouch material and will also maintain that material in a longitudinally straight orientation. This is important to assure the formation of square pouch corners and effective pouch seals.

The product collection means 86 may be of any form such as an exit conveyor or the like but should be positioned in a location somewhat adjacent to the product clamping means 80 to facilitate transfer of the immediately removed pouches directly to the product collection means 86.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An apparatus for horizontally forming, filling and sealing film pouch material comprising:

(a) a frame means for supporting a plurality of processing stations thereon and including a first section and a second section thereof, said frame means defining a horizontally extending support table in said first section and a support carriage in said second section, said support carriage being longitudinally movable along said frame means between a first position adjacent said first section and a second position further spatially displaced therefrom;

(b) a film unwinding device for continuously supplying of film pouch material;

(c) roller means for guiding of film pouch material from said film unwinding device onto said support table into a horizontally extending orientation onto said support table of said first section of said frame means;

(d) header sealing means positioned on said support table being selectively engageable with respect to the horizontally extending film pouch material to form a header seal adjacent to the top area thereof;

(e) labeling means located upon said horizontally extending support table to add a designation to the film pouch material traveling thereon;

(f) film registration means positioned upon said support table to indicate positioning of movement of the film pouch material upon said first and second sections and correction thereof;

(g) side sealing means secured with respect to said support carriage to be movable therewith, said side sealing means extending laterally across said support carriage to side seal horizontally extending film material at desired locations to form film pouches connected by support trim, said side sealing means being movable between an opened position adapted to receive film material therein and a closed clamping position forming a side seal between adjacent film pouches, said side sealing means being movable to the closed clamped position while said support carriage is in the first position and prior to movement thereof toward said second position to urge the film pouch material to move therewith as said support carriage moves from said first position to said second position, said side sealing means being movable to the opened position only after said support carriage completes movement to said second position and prior to initiating movement toward said first position;

(h) end sealing means secured to said support carriage to be movable therewith, said end sealing means being movable between an opened position adapted to receive horizontally extending film material therein and a closed clamping position forming an end seal in the film pouch, said end sealing means being movable to the closed clamping position while said support carriage is in the first position and prior to movement toward said second position to urge the film pouch material to move therewith as said support carriage moves from said first position to said second position, said end sealing means being movable to the opened position only after said support carriage completes movement to said second position and prior to initiating movement toward said first position;

(i) infeed chute means positioned at the same location as said end sealing means and adapted to fill product into each horizontally extending film pouch when said end sealing means is in the opened position;

(j) a trim clamping means being movable from an opened position adapted to receive excess trim material to a closed clamping position fixedly gripping the excess trim material, said trim clamping means being secured with respect to said frame means and adapted to move to the closed clamping position to grip the excess trim portion of the film pouch material while said support carriage is in the second position and prior to release of the film material by said side sealing means and said end sealing means to prevent movement of said film material with said support carriage as it travels from said second position to said first position, said trim clamping means being movable to the opened position releasing said trim portion of said film material while said support carriage is in the first position and after said side sealing means and said end sealing means have moved to the closed clamping position to allow movement of the film material with said support carriage as it moves from said first position to said second position; and (k) a product clamping means secured to said frame means and movable between an opened position adapted to receive a fully formed, filled and sealed horizontally extending film pouch therein and a closed clamping position firmly gripping the film pouch therein, said product clamping means adapted to move to the closed clamping position when said trim clamping means is also in the closed clamping position to remove the completed pouch from the excess trim material.

2. The apparatus as defined in claim 1 wherein said product clamping means is movable in a direction away from the trim portion of the film means and away from said trim clamping means after movement of said product clamping means to the closed clamping position to detach the formed, filled and sealed film pouch away from the trim waste portion.

3. The apparatus as defined in claim 2 further including a trim waste take-up assembly adjacent to said trim clamping means and downstream therefrom.

4. The apparatus as defined in claim 3 wherein said trim waste take-up assembly is power driven.

5. The apparatus as defined in claim 1 wherein said film unwinding device includes a drive means to facilitate the supplying of film pouch material.

6. The apparatus as defined in claim 5 wherein said drive means is rendered operative whenever said support carriage is moving from said first position to said second position.

7. The apparatus as defined in claim 6 wherein the film pouch material is provided in a roll driven by said drive means with a circumferential speed approximately equal to the longitudinal speed of movement of said support carriage from said first position to said second position.

8. The apparatus as defined in claim 1 wherein said roller means includes a plurality of individual rollers to maintain the squareness and flatness of supplied film pouch material.

9. The apparatus as defined in claim 1 wherein said infeed chute means is adapted to fill a single pouch for each movement cycle of said support carriage.

10. The apparatus as defined in claim 9 wherein said first position and said second position of said support carriage are spatially separated by a distance equal to the width of a single film pouch allowing each individual pouch to be sequentially presented in front of said infeed chute means for product filling thereof.

11. The apparatus as defined in claim 1 wherein said header sealing means forms a header seal in each film pouch adjacent to but spaced from the top seal thereof.

12. The apparatus as defined in claim 1 wherein the film pouch material includes regularly positioned coded markings thereon capable of being read by said film registration means to cause proper positioning of the film pouch material.

13. The apparatus as defined in claim 1 wherein said labeling means includes a hot stamping means for affixing a desired designation onto the film pouch material.

14. The apparatus as defined in claim 1 wherein said labeling means includes a header card assembly for placing a card at the header area of each individual film pouch material area.

15. The apparatus as defined in claim 1 further including a punch means for punching a hole in the film pouch for air evacuation and display thereof.

16. The apparatus as defined in claim 1 further including an infeed conveyor to provide product to said infeed chute means.

17. The apparatus as defined in claim 1 wherein said apparatus includes a piston power means for driving of the product and infeed chute means in front of the unsealed edge of the film pouch material to load product therein and for withdrawing said infeed chute means therefrom.

18. The apparatus as defined in claim 1 wherein said infeed chute means is moved through the unsealed end of each film pouch and removed therefrom after the product has been deposited therein.

19. The apparatus as defined in claim 1 wherein said labeling means is adapted to apply a label to the exterior of each film material pouch.

20. The apparatus as defined in claim 18 wherein said end sealing means includes an upper jaw means and a lower jaw means adapted to selectively move toward each other to clamp and end seal each film pouch responsive to movement of said end sealing means to the closed clamping position.

21. The apparatus as defined in claim 20 wherein said piston power means drives said infeed chute means between the spatially separated upper and lower jaw means to fill the film pouch when said end sealing means is in the opened position.

22. The apparatus as defined in claim 1 further including a product collection means positioned below said product clamping means to receive and collect the completed pouches therefrom.

23. The apparatus as defined in claim 12 wherein said film registration means includes a photocell means for reading the regularly positioned coded markings on the film pouch material.

24. An apparatus for horizontally forming, filling and sealing film pouch material comprising:

(a) a frame means for supporting a plurality of processing stations thereon and including a first section and a second section thereof, said frame means defining a horizontally extending support table in said first section and a support carriage in said second section, said support carriage being longitudinally movable along said frame means between a first position adjacent said first section and a second position further spatially displaced therefrom;

(b) a film unwinding device for continuously supplying of film pouch material which includes a drive means being rendered operative whenever said support carriage is moving from said first position to said second position, said film pouch material being provided in a roll driven by said drive means with a circumferential speed approximately equal to the longitudinal speed of movement of said support carriage from said first position to said second position;

(c) roller means which includes a plurality of individual rollers for maintaining squareness and flatness of supplied film pouch material for guiding of the film pouch material from said film unwinding device onto said support table into a horizontally extending orientation onto said support table of said first section of said frame means;

(d) header sealing means positioned on said support table being selectively engageable with respect to the horizontally extending film pouch material to form a header seal adjacent to the top area thereof;

(e) labeling means located upon said horizontally extending support table to add a designation to the film pouch material traveling thereon;

(f) film registration means which includes a photocell means positioned upon said support table to indicate positioning of movement of the film pouch material upon said first and second sections by the reading of regularly positioned coded markings on the film pouch material and correction of positioning of the film pouch material;

(g) side sealing means secured with respect to said support carriage to be movable therewith, said side sealing means extending laterally across said support carriage to side seal horizontally extending film material at desired locations to form film pouches connected by support trim, said side sealing means being movable between an opened position adapted to receive film material therein and a closed clamping position forming a side seal between adjacent film pouches, said side sealing means being movable to the closed clamped position while said support carriage is in the first position and prior to movement thereof toward said second position to urge the film pouch material to move therewith as said support carriage moves from said first position to said second position, said side sealing means being movable to the opened position only after said support carriage completes movement to said second position and prior to initiating movement toward said first position;

(h) end sealing means secured to said support carriage to be movable therewith, said end sealing means being movable between an opened position adapted to receive horizontally extending film material therein and a closed clamping position forming an end seal in the film pouch, said end sealing means being movable to the closed clamping position while said support carriage is in the first position and prior to movement toward said second position to urge the film pouch material to move therewith as said support carriage moves from said first position to said second position, said end sealing means being movable to the opened position only after said support carriage completes movement to said second position and prior to initiating movement toward said first position, said end sealing means including an upper jaw means and a lower jaw means adapted to selectively move toward one another to clamp and end seal each film pouch responsive to movement of said end sealing means to the closed clamping position;

(i) infeed chute means positioned at the same location as said end sealing means and adapted to extend between said upper and lower jaw means, when in the opened position, into each horizontally extending film pouch to fill product therein when said end sealing means is in the opened position, said infeed chute means being adapted to enter and fill a single pouch for each movement cycle of said support carriage, said first position and said position of said support carriage being spatially separated from one another by a distance equal to the width of a single film pouch allowing each individual pouch to be sequentially presented in front of said infeed chute means for product filling thereof;

(j) an infeed conveyor to transport product to said infeed chute means;

(k) a piston power means for driving of said infeed chute means adjacent to the unsealed edge of the film pouch material to load product therein and for withdrawing said infeed chute means therefrom;

(l) a trim clamping means being movable from an opened position adapted to receive excess trim material to a closed clamping position fixedly gripping the excess trim material, said trim clamping means being secured with respect to said frame means and adapted to move to the closed clamping position to grip the excess trim portion of the film pouch material while said support carriage is in the second position and prior to release of the film material by said side sealing means and said end sealing means to prevent movement of said film material with said support carriage as it travels from said second position to said first position, said trim clamping means being movable to the opened position releasing said trim portion of said film material while said support carriage is in the first position and after said side sealing means and said end sealing means have moved to the closed clamping position to allow movement of the film material with said support carriage as it moves from said first position to said second position;

(m) a product clamping means secured to said frame means and movable between an opened position adapted to receive a fully formed, filled and sealed horizontally extending film pouch therein and a closed clamping position firmly gripping the film pouch therein, said product clamping means adapted to move to the closed clamping position when said trim clamping means is also in the closed clamping position to remove the completed pouch from the excess trim material, said product clamping means being movable in a direction away from the trim portion of the film means and away from said trim clamping means after movement of said product clamping means to the closed position to detach the formed, filled and sealed film pouch away from the trim waste portion;

(n) a trim waste take-up assembly adjacent to said trim clamping means and downstream therefrom, said trim waste take-up assembly being power driven; and (o) a product collection means positioned below said product clamping means to receive and collect the completed pouches therefrom.

* * * * *